US010557225B2

(12) United States Patent
Hashimoto

(10) Patent No.: US 10,557,225 B2
(45) Date of Patent: Feb. 11, 2020

(54) SEWING MACHINE

(71) Applicant: Yamato Mishin Seizo Kabushiki Kaisha, Osaka-shi (JP)

(72) Inventor: Seiji Hashimoto, Toyonaka (JP)

(73) Assignee: YAMATO MISHIN SEIZO KABUSHIKI KAISHA, Osaka (JP)

( * ) Notice: Subject to any disclaimer, the term of this patent is extended or adjusted under 35 U.S.C. 154(b) by 305 days.

(21) Appl. No.: 15/644,162

(22) Filed: Jul. 7, 2017

(65) Prior Publication Data

US 2018/0023232 A1 Jan. 25, 2018

(30) Foreign Application Priority Data

Jul. 22, 2016 (JP) ..... 2016-144317

(51) Int. Cl.
*D05B 35/02* (2006.01)
*D05B 23/00* (2006.01)
*D05B 29/00* (2006.01)

(52) U.S. Cl.
CPC ..... *D05B 35/02* (2013.01); *D05B 23/006* (2013.01); *D05B 29/00* (2013.01)

(58) Field of Classification Search
CPC ..... D05B 37/04; D05B 23/006; D05B 29/10; D05B 35/02
See application file for complete search history.

(56) References Cited

U.S. PATENT DOCUMENTS 4,467,734 A * 8/1984 Rohr ..... D05B 33/00 112/153
4,546,716 A * 10/1985 Babson ..... D05B 1/20 112/147
5,188,047 A * 2/1993 Rohr ..... D05B 69/20 112/131
5,251,557 A * 10/1993 Rohr ..... D05B 35/102 112/306
5,349,913 A * 9/1994 Schramayr ..... D05B 23/00 112/470.13
5,383,410 A * 1/1995 Mukai ..... D05B 33/00 112/143
5,406,900 A * 4/1995 Schramayr ..... D05B 23/00 112/104

(Continued)

FOREIGN PATENT DOCUMENTS

JP 2004-236769 A 8/2004

*Primary Examiner* — Danny Worrell
(74) *Attorney, Agent, or Firm* — Ladas & Parry, LLP

(57) ABSTRACT

Provided is a sewing machine including: a cylinder unit 3 configured to support two materials Fi and Fo having annular edges by being inserted therethrough while they are stacked, with one being located on the inner wheel side and the other being located on the outer wheel side; a stitch plate 12 configured to support the material Fi on the inner wheel side supported by the cylinder unit 3 by abutting it from below; a material presser 13 configured to press the material Fo on the outer wheel side supported by the cylinder unit 3 above the stitch plate 12; and a material sandwiching unit 41 provided on the near side of the stitch plate 12 and the material presser 13 and configured to sandwich, from above and below, the two materials Fi and Fo stacked, with the material Fi on the inner wheel side being located on the lower side and the material Fo on the outer wheel side being located on the upper side.

4 Claims, 8 Drawing Sheets

(56) References Cited

U.S. PATENT DOCUMENTS

| | | | | | |
|---|---|---|---|---|---|
| 5,419,268 | A * | 5/1995 | Fyler | D05B 23/00 | 112/470.14 |
| 5,505,149 | A * | 4/1996 | Schramayr | D05B 35/00 | 112/155 |
| 5,642,681 | A * | 7/1997 | Adamski, Jr. | D05B 19/12 | 112/155 |
| 5,676,078 | A * | 10/1997 | Adamski, Jr. | D05B 19/12 | 112/475.03 |
| 5,806,449 | A * | 9/1998 | Schramayr | D05B 35/10 | 112/470.29 |
| 5,924,376 | A * | 7/1999 | Olewicz | D05B 33/00 | 112/122.1 |
| 2018/0023232 | A1 * | 1/2018 | Hashimoto | D05B 29/00 | 112/235 |

* cited by examiner

SEWING MACHINE

CROSS-REFERENCE TO RELATED APPLICATION

This application claims priority to Japanese Patent Application No. 2016-144317, filed on Jul. 22, 2016, the disclosure of which is incorporated herein by reference in its entirety.

BACKGROUND OF THE INVENTION

Field of the Invention

The present invention relates to a sewing machine used when sewing two materials having annular edges.

Background Art

Conventionally, when sewing a tubular sleeve to a tubular body such as sleeving operation of T-shirts, an overlock sewing machine, for example, shown in JP 2004-236769 A has been used. When sewing the sleeve to the body in this example, two materials (the material of the body and the material of the sleeve) having annular edges are sewn together. In the case of using the aforementioned overlock sewing machine, the annular edges of the materials are sewn while they are located above a stitch plate of the overlock sewing machine.

In such a conventional sewing method, the materials cover over the position where a needle that performs the sewing passes through the materials on the stitch plate (needle drop slot), thereby blocking the sight of the sewing operator. Therefore, the sewing operator has been forced to take an unreasonable posture such as a posture of lifting the materials, in order to ensure the sight so as to check the sewing state. Moreover, one hand needs to be used for lifting the materials or the like, and therefore the positioning of the two pieces of material has been also difficult. Accordingly, the operation efficiency has been deteriorated to hinder the mass production of sewn products.

SUMMARY OF THE INVENTION

In view of the aforementioned problems, it is therefore an object of the present invention to provide a sewing machine that allows good operation efficiency, particularly, when sewing two materials having annular edges.

The following presents a simplified summary of the invention disclosed herein in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

The present invention is a sewing machine including: a cylinder unit configured to support two materials having annular edges by being inserted therethrough while the two materials are stacked, with one being located on the inner wheel side and the other being located on the outer wheel side; a stitch plate configured to support the material on the inner wheel side supported by the cylinder unit by abutting it from below; a material presser configured to press the material on the outer wheel side supported by the cylinder unit above the stitch plate; and a material sandwiching unit provided on the near side of the stitch plate and the material presser and configured to sandwich, from above and below, the two materials stacked, with the material on the inner wheel side being located on the lower side and the material on the outer wheel side being located on the upper side.

The configuration can be such that the material sandwiching unit includes a curl-removing mechanism configured to straighten curls occurring on the edges of the two materials, the material sandwiching unit includes, as the curl-removing mechanism, inclined parts having edges of shapes extending backward from the farther side of the edges of the materials toward the edge side at the position where the edges of the two materials pass therethrough, and the inclined parts have edge parts having a smaller thickness on the near side than on the back side.

The configuration can be such that an edge guide located rearward of the curl-removing mechanism and configured to abut the edges of the two materials; and a knife located rearward of the edge guide and configured to cut the two materials at a specific distance from the edge guide are further provided.

The configuration can be such that a relative position between the edge guide and the knife is adjustable so as to allow the specific distance to be changed.

BRIEF DESCRIPTION OF THE DRAWINGS

The foregoing and other features of the present invention will become apparent from the following description and drawings of an illustrative embodiment of the invention in which.

DETAILED DESCRIPTION OF THE PREFERRED EMBODIMENT

Next, the present invention will be described with reference to an embodiment. In order to express the forward and backward directions, the closer side to the sewing operator will be referred to as "near side", and the farther side will be referred to as "back side (rear side)". Further, the upward, downward, left, and right directions are expressed as directions when a sewing machine 1 is seen from the operator.

The sewing machine 1 of this embodiment is suitable as a "sewing machine dedicated to sleeve application", and is, for example, an overlock sewing machine used for operation of joining tubular materials to each other such as operation of sewing a tubular sleeve to an arm through hole of a tubular body (T-shirt sleeving operation, for example). The edge of the arm through hole of the body and the edge of the sleeve, through which an arm of a wearer of the cloth passes, are annular and are as they are cut without being subjected to processing such as folding, in this embodiment. The T-shirt sleeving operation is just an example, and the sewing machine 1 of this embodiment can be used widely for operations of sewing annular edges of two materials to each other. Further, as the tubular materials, materials formed by circular knitting so as not to have a joint (side seam) in the circumferential direction can be used.

Figure 1:
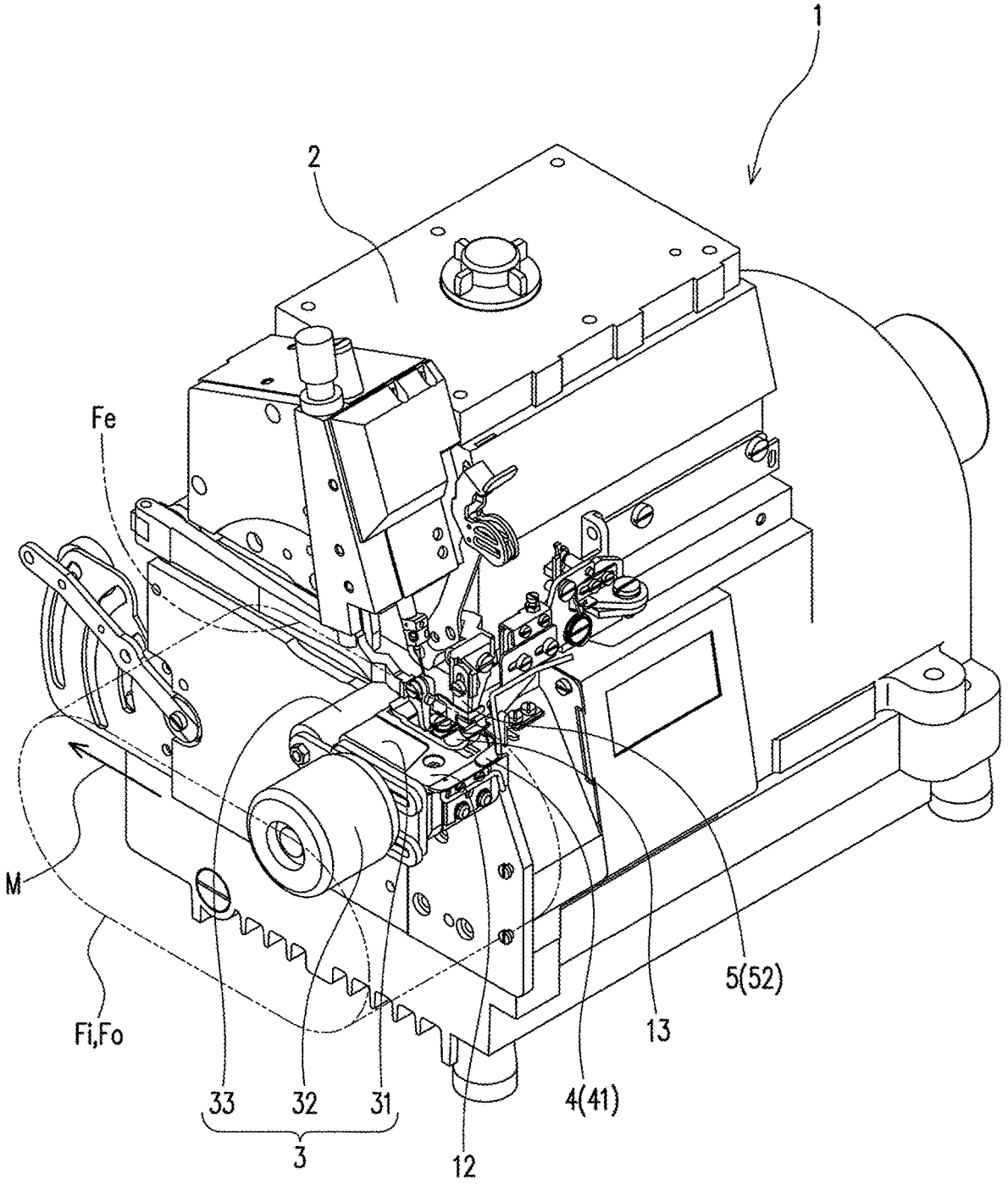
FIG. 1 is a perspective view showing a sewing machine of an embodiment of the present invention.

As shown in FIG. 1, the sewing machine 1 sews two materials Fi and Fo (shown by dashed lines in the figure) having annular edges and are stacked inside and outside, with one being located on the inner wheel side and the other being located on the outer wheel side. The two materials Fi and Fo of this embodiment are the material of the body and the material of the sleeve, for example, in a T-shirt and are independent and separate (not continuous) materials.

The sewing machine 1 of this embodiment includes a sewing machine body 2, a cylinder unit 3 projecting from the sewing machine body 2 toward one side (specifically, the left side), a curl-removing mechanism 4, and a material cutting mechanism 5. Mechanisms in common with general sewing machines are not described in detail except for those particularly in need of explanation.

The cylinder unit 3 is a part configured to support the two materials Fi and Fo on the inner wheel side and the outer wheel side from below by being inserted therethrough while they are stacked. Since the cylinder unit 3 can be inserted through the two materials Fi and Fo, the annular edges of the materials Fi and Fo can be sewn below a stitch plate 12, for example, as being different from the conventional overlock sewing machine disclosed in JP 2004-236769 A.

Figure 2:
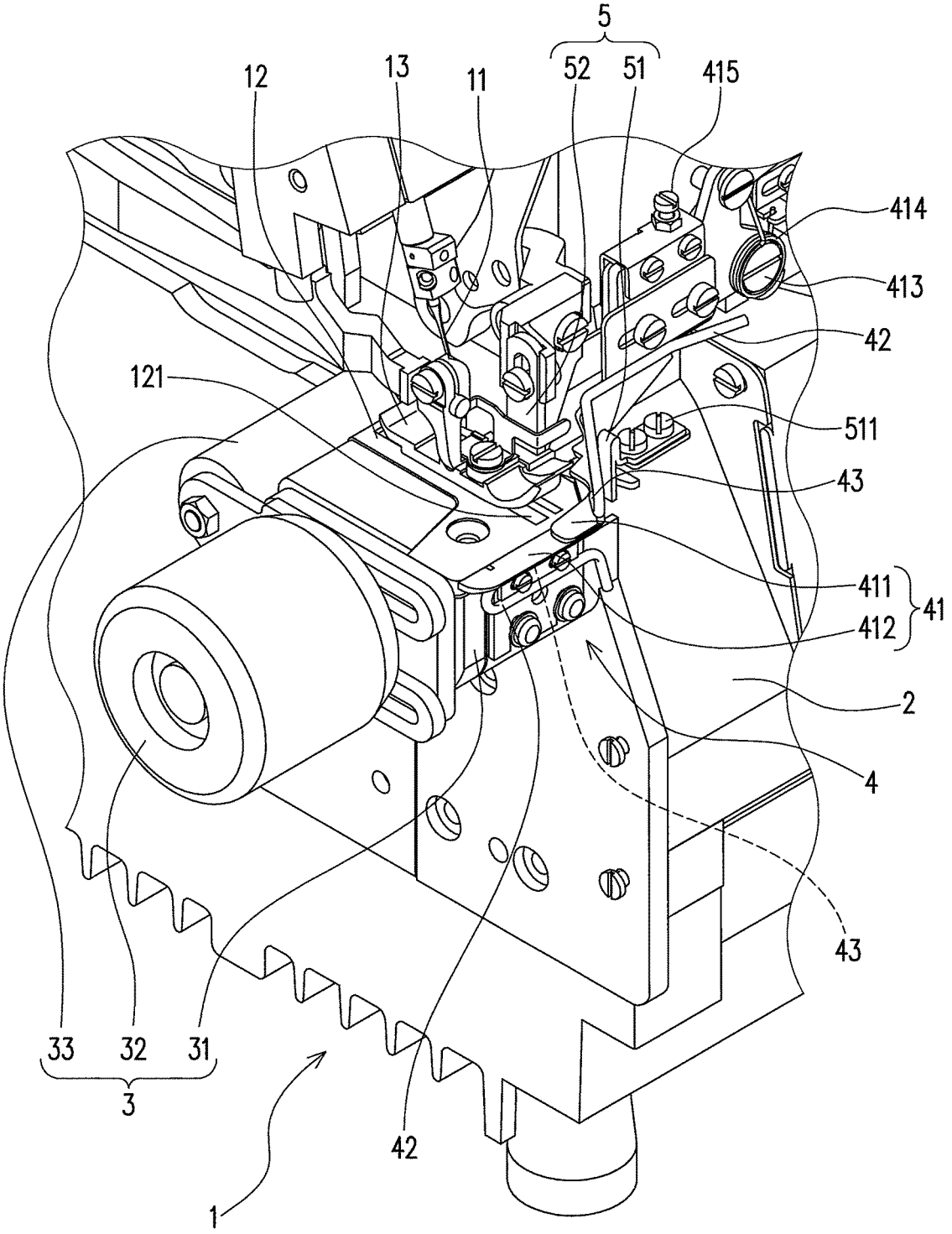
FIG. 2 is an enlarged perspective view of a main part of the sewing machine of the aforementioned embodiment as seen from the left front side.

As shown in FIG. 2, the cylinder unit 3 of this embodiment includes a cylinder body 31 projecting to the left from the sewing machine body 2, a main roller 32 projecting to the left from the cylinder body 31 and configured to be freely rotatable about the rotation axis extending in the left and right direction, and a sub roller 33 located rearward of the cylinder body 31, having a smaller diameter than the main roller 32, and configured to be freely rotatable about the rotation axis extending in the left and right direction. The stitch plate 12 is provided on the top of the cylinder body 31. The main roller 32 and the sub roller 33 rotate as the two materials Fi and Fo are fed backward, that is, in the feed direction M (see FIG. 1). Therefore, the two materials Fi and Fo can be smoothly fed backward from the near side above the cylinder unit 3.

Since the cylinder unit 3 can be inserted through the two materials Fi and Fo having annular edges, the materials Fi and Fo can be sewn with their annular edges below the stitch plate 12, as shown in FIG. 1. Therefore, the materials do not cover over the position where a needle 11 that performs the sewing passes through the materials (needle drop slot) on the stitch plate 12, and thus the sight of the sewing operator is less likely to be blocked by the materials Fi and Fo. Further, there is no need to use one hand in order to ensure the sight, and therefore both hands can be concentrated on the sewing operation.

In particular, for example, the shape of the annular edge of the arm through hole of the tubular body and the shape of the annular edge of the sleeve, which are materials of the T-shirt, are not completely the same as each other in most cases, such as that the flat degree is different or a joint is present in the middle in the circumferential direction. Therefore, the operator constantly performs fine adjustment for positioning the two materials Fi and Fo during the sewing operation. Since the sewing machine 1 of this embodiment allows both hands to be concentrated on the sewing operation as described above, the fine adjustment can be reliably performed. Therefore, the sewing quality can be improved, and the sewing operation can be accelerated, so that the operation efficiency can be improved, and sewn products can be mass-produced. Accordingly, the production cost of sewn products can be reduced.

As shown in FIG. 2, the sewing machine 1 of this embodiment includes the needle 11 configured to reciprocally move during the sewing, the stitch plate 12 configured to receive the reciprocally moving needle 11, a material presser 13, and a drive mechanism, a transmission mechanism, or the like, for operating each unit, which are not shown. The stitch plate 12 is provided on the top of the cylinder body 31 of the cylinder unit 3 and has a needle drop slot (not shown) capable of receiving the reciprocally moving needle 11. The stitch plate 12 abuts and supports the material Fi on the inner wheel side supported by the cylinder unit 3 from below. Though not clearly seen in the figure, the stitch plate 12 has a feeding mechanism 121 configured to feed the material Fi on the inner wheel side backward. The material presser 13 presses the material Fo on the outer wheel side supported by the cylinder unit 3 above the stitch plate 12. The two materials Fi and Fo on the inner wheel side and the outer wheel side are sandwiched between the stitch plate 12 and the material presser 13, and therefore both pieces are fed backward by the feeding mechanism 121 during the sewing.

The curl-removing mechanism 4 is a mechanism configured to straighten curls C occurring on the edges Fe on the sewing side of the two materials Fi and Fo on the inner wheel side and the outer wheel side. The curls C that can be straightened by the curl-removing mechanism 4 are portions formed by the near regions of the edges Fe of the materials Fi and Fo on the sewing side curling along the edges (see FIG. 8; the lower ends of the materials are shown as being cut in FIG. 8, though they are actually annular, for convenience of explanation). In particular, when the materials Fi and Fo are stretched in forward and backward directions, the curls C tend to occur.

Figure 3:
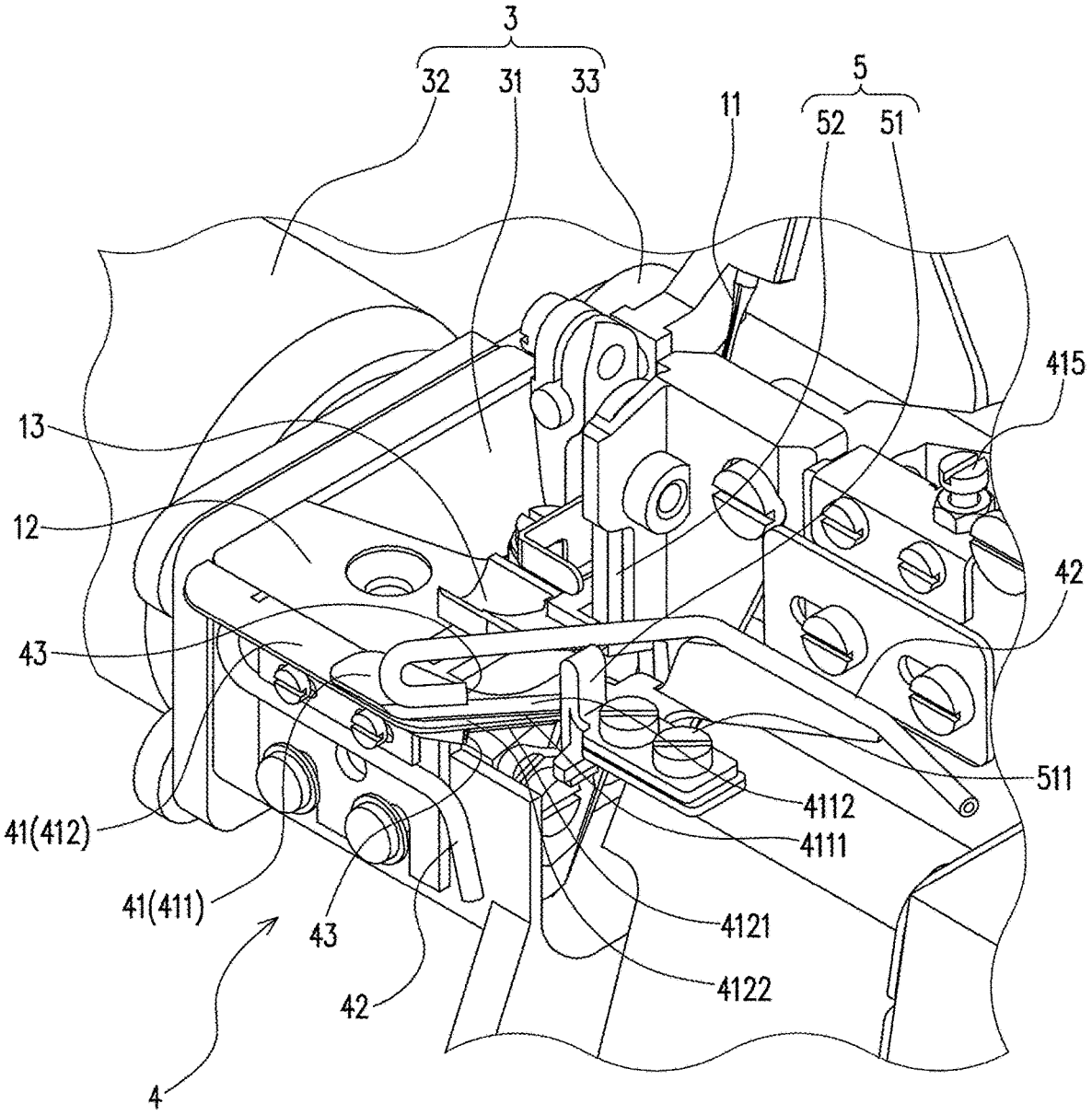
FIG. 3 is an enlarged perspective view of the main part of the sewing machine of the aforementioned embodiment as seen from the right front side.

As shown in FIG. 2 and FIG. 3, the curl-removing mechanism 4 of this embodiment includes a material sandwiching unit 41 and air ejectors 43. The material sandwiching unit 41 is provided on the near side of the stitch plate 12 and the material presser 13. The material sandwiching unit 41 sandwiches the two materials Fi and Fo from above and below while they are stacked so that the material Fi on the inner wheel side is located on the lower side and the material Fo on the outer wheel side is located on the upper side. Therefore, the material sandwiching unit 41 includes an upper material sandwiching part 411 located on the upper side and a lower material sandwiching part 412 located on the lower side. Further, the material sandwiching unit 41 includes a movement fulcrum 413, a biasing part 414, and a space restricting part 415. The respective portions of the upper material sandwiching part 411 and the lower material sandwiching part 412 opposed to the materials Fi and Fo are formed as plates (see FIG. 6).

A moving mechanism makes the spacing in the vertical direction between the upper material sandwiching part 411 and the lower material sandwiching part 412 variable. The moving mechanism is a mechanism that allows the upper material sandwiching part 411 to be pivotable about the movement fulcrum 413 within a specific range from the lower material sandwiching part 412 in this embodiment. As the movement fulcrum 413, a screw is used in this embodiment, but the configuration is not limited as long as it can support the movement of the upper material sandwiching part 411 from the lower material sandwiching part 412. The moving mechanism includes an operating part, which is not shown, and the operating part is operated by the operator when the two materials Fi and Fo are sandwiched between the material sandwiching parts 411 and 412, so that the material sandwiching parts 411 and 412 can be moved so as to move away from each other in the vertical direction. In this embodiment, the upper material sandwiching part 411 is configured to pivot from the lower material sandwiching part 412, but the configuration may be, for example, such that the upper material sandwiching part 411 and the lower material sandwiching part 412 move in the perpendicular direction while they are kept parallel to each other. Further, the configuration can be also such that only the lower material sandwiching part 412 moves, or both of the upper material sandwiching part 411 and the lower material sandwiching part 412 move.

In this embodiment, the biasing part 414 is a coil spring provided around the screw serving as the movement fulcrum 413, and the spacing between the upper material sandwiching part 411 and the lower material sandwiching part 412 is maintained by the bias of the biasing part 414. Therefore, in the case where portions of the materials Fi and Fo, for example, to which tapes are attached and thus which have an increased thickness pass through the material sandwiching unit 41, the spacing between the upper material sandwiching part 411 and the lower material sandwiching part 412 expands, and after the portions pass therethrough, the spacing automatically returns to the original position by the bias of the biasing part 414. The spacing between the upper material sandwiching part 411 and the lower material sandwiching part 412 is adjustable by a bolt included in the space restricting part 415.

The two materials Fi and Fo sandwiched by the material sandwiching unit 41 can be fed between the stitch plate 12 and the material presser 13. Therefore, stable sewing is possible.

Further, there is only a space to sandwich the two materials Fi and Fo between the upper material sandwiching part 411 and the lower material sandwiching part 412, and thus, for example, a plate-shaped separator or the like to separate the two materials Fi and Fo does not intervenes therebetween. Therefore, there is no need to retract the separator or the like before the materials Fi and Fo being fed backward reach the needle drop slot of the stitch plate 12, and thus there is no need to reduce the sewing speed or to temporarily stop the sewing operation, which is advantageous in mass production of sewn products.

As shown in FIG. 3, the material sandwiching unit 41 further has inclined parts 4111 and 4121 having edges of shapes extending backward from the farther side of the edges of the materials Fi and Fo (left side in this embodiment) toward the edge side (right side in this embodiment) at the position where the edges of the two materials Fi and Fo on the sewing side (right edges in this embodiment) pass therethrough. The edges of the inclined parts 4111 and 4121 intersect the motion trajectory of the edges Fe (right edges) of the two materials Fi and Fo on the sewing side. The upper material sandwiching part 411 and the lower material sandwiching part 412 respectively have the inclined parts 4111 and 4121. The inclined parts 4111 and 4121 are provided at positions substantially coinciding with each other in the vertical direction.

The inclined parts 4111 and 4121 of this embodiment have shapes extending backward from the body side (left side in this embodiment) toward the sleeve distal end side (right side in this embodiment) at the position where the edges Fe (right edges in this embodiment) of the two materials Fi and Fo on the sewing side pass therethrough. The "shapes extending backward" means shapes such that edges 4113 and 4123 of the inclined parts 4111 and 4121 seem like "lines rising to the right" when the material sandwiching unit 41 is seen from above. Further, the edges 4113 and 4123 of the inclined parts 4111 and 4121 of this embodiment have linear shapes. However, there is no limitation to this, and the edges 4113 and 4123 can have curved shapes, for example.

Figure 8:
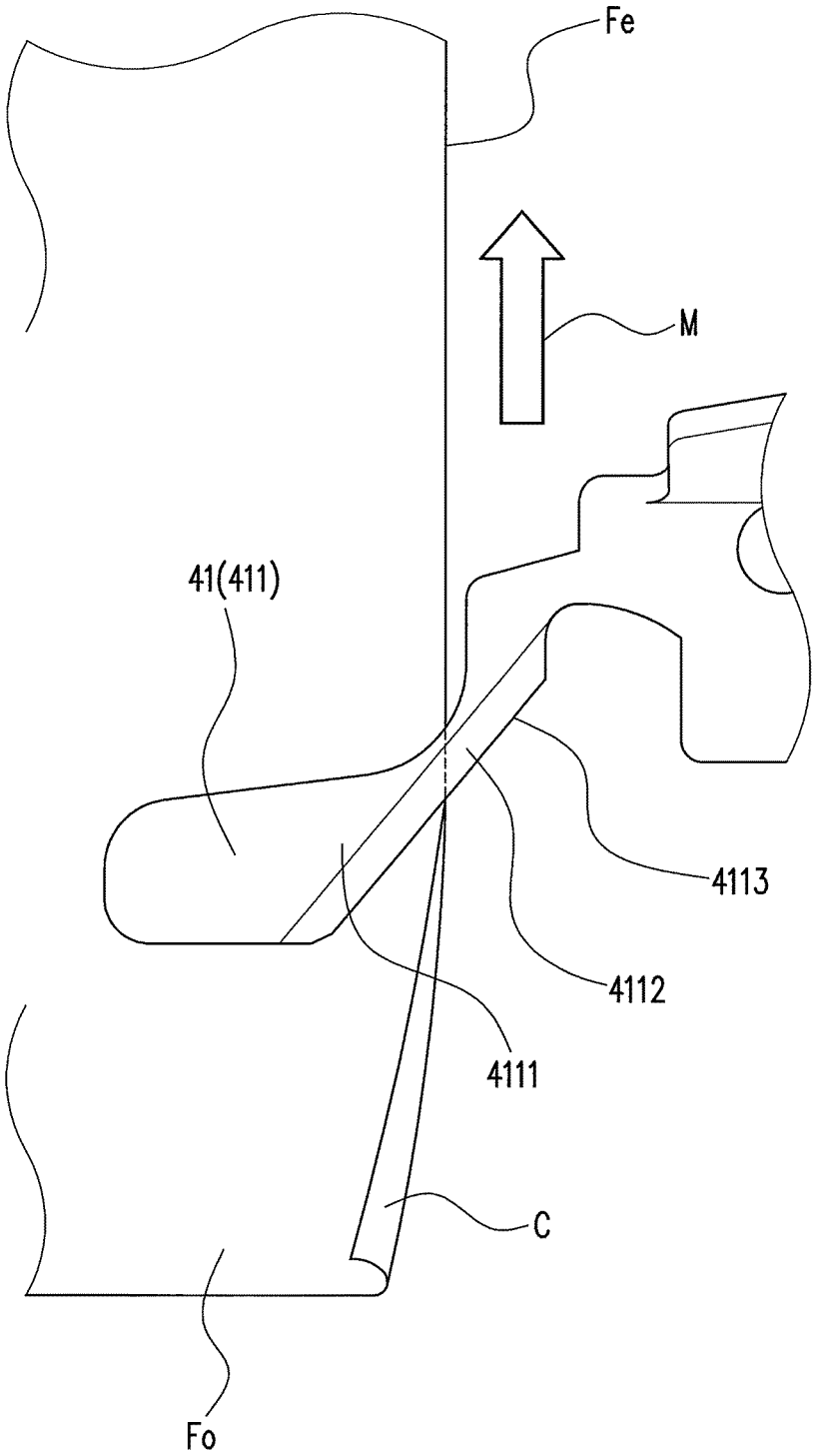
FIG. 8 is a schematic view showing the appearance that curls that have occurred in the material are straightened by inclined parts of the material sandwiching unit of the sewing machine of the aforementioned embodiment.

The two materials Fi and Fo are moved backward, that is, in the feed direction M while they are sandwiched between the upper material sandwiching part 411 and the lower material sandwiching part 412. Therefore, as shown in FIG. 8, the curls C occurring on the edges Fe (right edges) of the two materials Fi and Fo on the sewing side are pressed to be expanded toward the right by the inclined parts 4111 and 4121 of the upper material sandwiching part 411 and the lower material sandwiching part 412, so as to be opposed to each other and flattened along the spacing between the upper material sandwiching part 411 and the lower material sandwiching part 412. Thus, the curls C are straightened.

Figure 4:
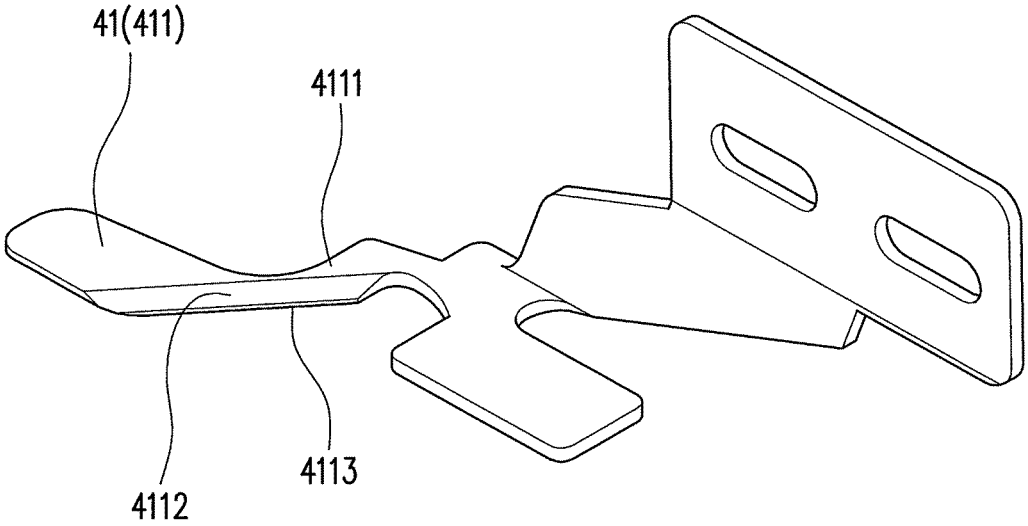
FIG. 4 is a perspective view showing an upper material sandwiching part (single body) of the sewing machine of the aforementioned embodiment as seen from above.
Figure 5:
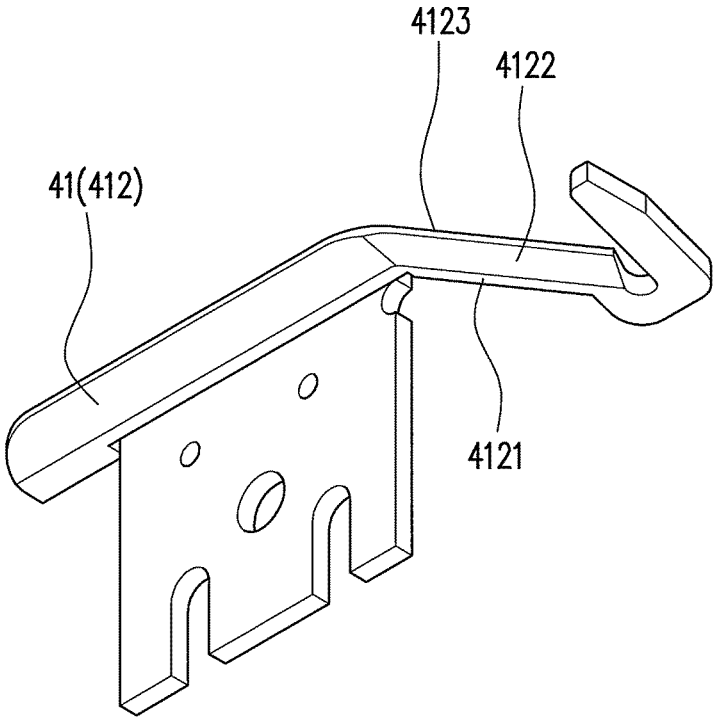
FIG. 5 is a perspective view showing a lower material sandwiching part (single body) of the sewing machine of the aforementioned embodiment as seen from below.
Figure 6:
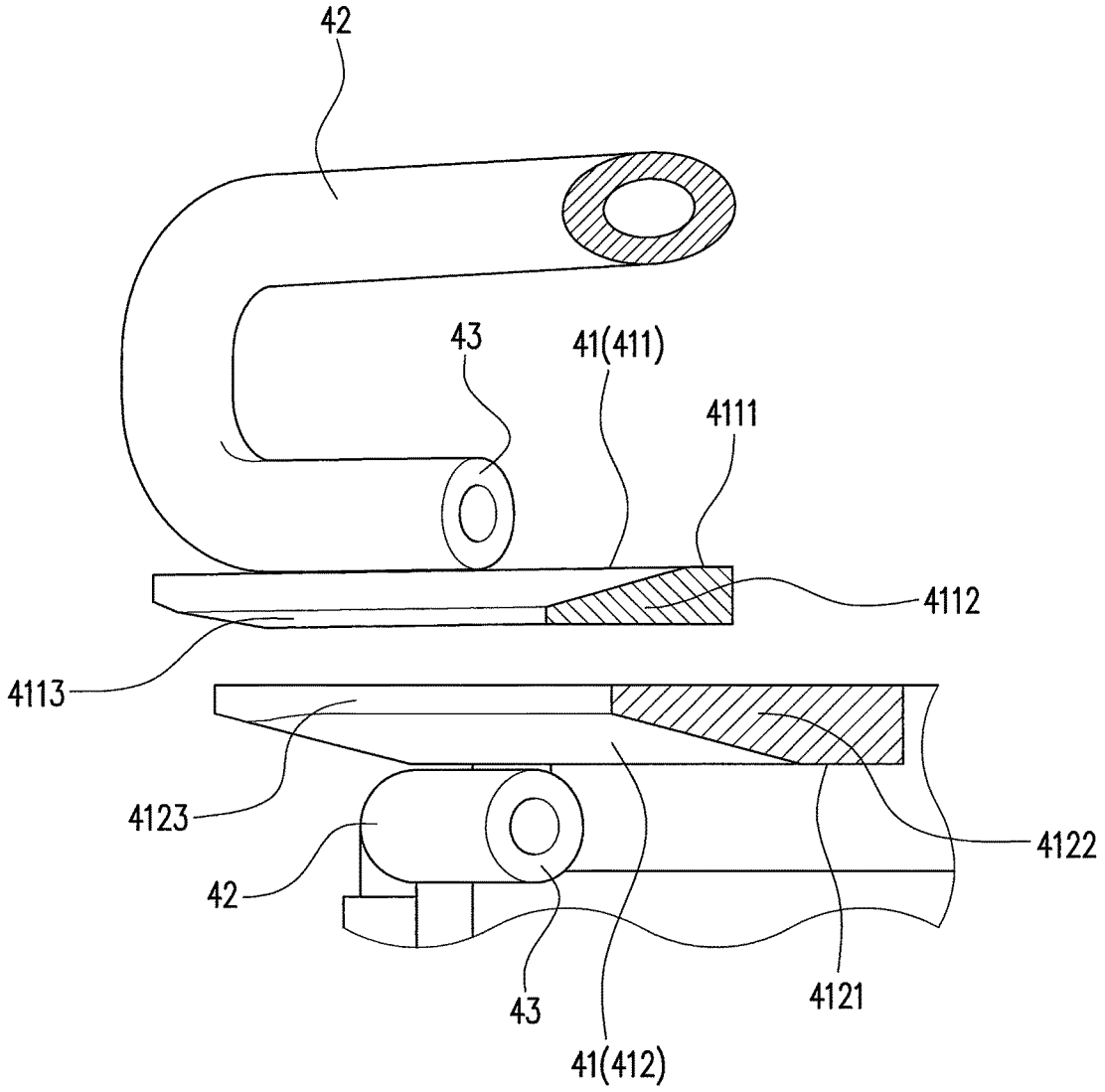
FIG. 6 is an enlarged sectional view showing a main part of a material sandwiching unit of the sewing machine of the aforementioned embodiment.

As shown in FIG. 4 to FIG. 6, the inclined parts 4111 and 4121 have edge parts 4112 and 4122 having a smaller thickness on the near side (the side of the edges 4113 and 4123) than on the back side. In this embodiment, the sectional shape of each of the edge parts 4112 and 4122 is a wedge shape having an inclination on only one of the upper and lower sides. Since the material sandwiching unit 41 includes the inclined parts 4111 and 4121 as the curl-removing mechanism 4, and the inclined parts 4111 and 4121 have the edge parts 4112 and 4122 of shapes having a smaller thickness (thinner) at the edges 4113 and 4123, it is easy to insert the material sandwiching unit 41 into the curved portions of the curls C occurring on the edges of the two materials Fi and Fo on the inner wheel side and the outer wheel side. Therefore, it is easy to position the inclined parts 4111 and 4121 along the two materials Fi and Fo with the curls C being pressed to be expanded (see FIG. 8). Thus, the curls C can be straightened up. Accordingly, the problem that the two materials Fi and Fo are sandwiched between the upper material sandwiching part 411 and the lower material sandwiching part 412 in the state where the curls C are incompletely removed (in the state where the curls C remain) can be suppressed, and the sewing is not interfered by the curls C, thereby allowing efficient sewing operation. Depending on the circumstances, the inclined parts 4111 and 4121 can be configured not to have the edge parts 4112 and 4122.

As shown in FIG. 2 and FIG. 3, in this embodiment, air pipes 42 configured to allow compressed air to pass therethrough are arranged on the top of the upper material sandwiching part 411 and the bottom of the lower material sandwiching part 412 along the respective surfaces, and the opening ends of the air pipes 42 serve as the air ejectors 43. The portions of the materials Fi and Fo where the curls C have occurred can be moved to the right by the pressure of the airflows ejected from the air ejectors 43, and therefore the curls C can be straightened. Thus, in this embodiment, the curls C can be straightened by both of the inclined parts 4111 and 4121 having the edge parts 4112 and 4122 and the airflows ejected from the air ejectors 43. Therefore, the curls C can be effectively removed.

Figure 7A:
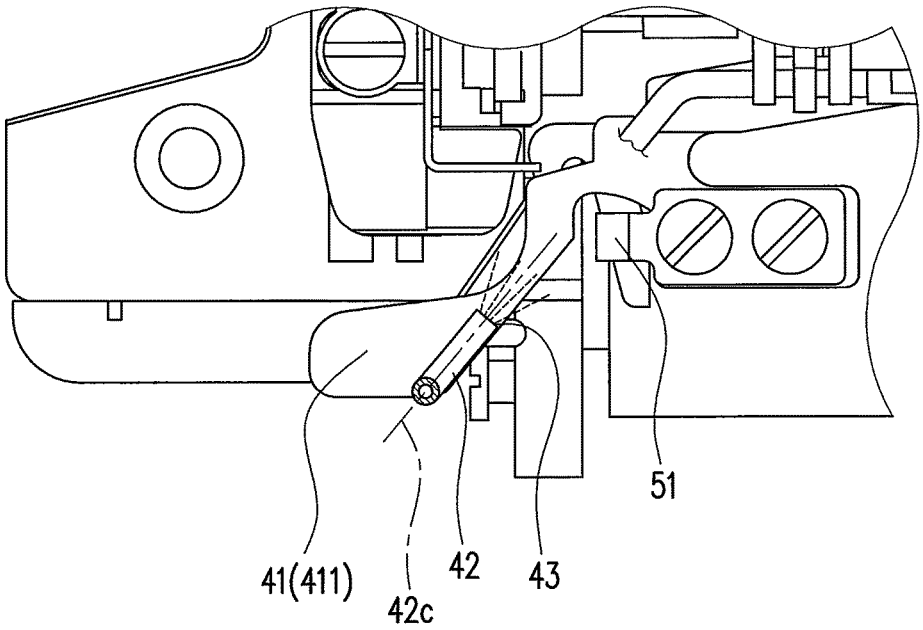
FIG. 7A is a view of the top of the upper material sandwiching part, showing the positional relationship between an air ejector and a material guide of the sewing machine of the aforementioned embodiment.
Figure 7B:
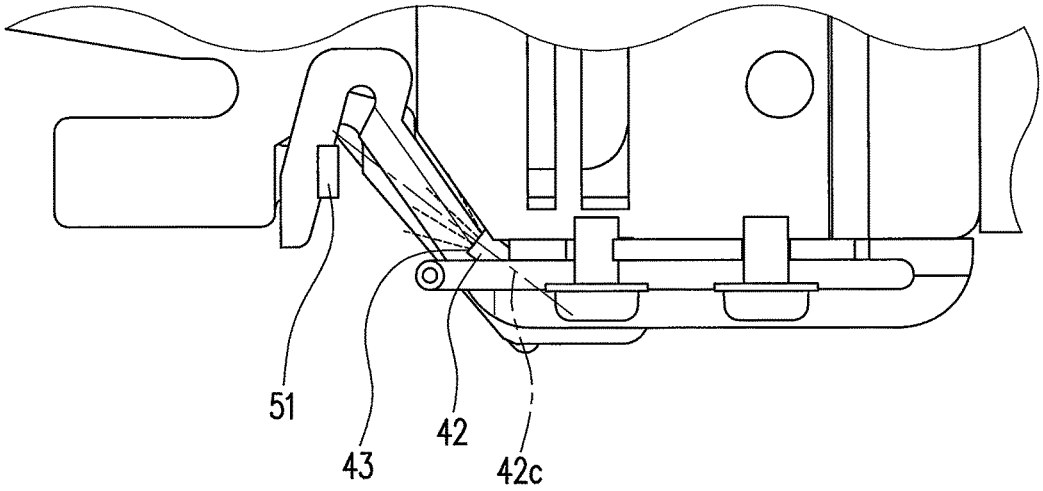
FIG. 7B is a view of the bottom of the lower material sandwiching part, showing the positional relationship between the air ejector and the material guide of the sewing machine of the aforementioned embodiment.

As shown in FIGS. 7A and 7B, the center lines (imaginary lines) 42*c* in the end portions of the air pipes 42 do not coincide with an edge guide 51, which will be described later, and set shifted therefrom. Therefore, the centers of the airflows ejected from the air ejectors 43 (schematically shown in FIGS. 7A and 7B) do not hit the edge guide 51. Therefore, since the airflows do not directly hit the edge guide 51, the problem that turbulent flows occur in the airflows to cause fluttering in the curls C before being removed by the material sandwiching unit 41, thereby causing an adverse effect on the removal of the curls C can be suppressed.

As shown in FIG. 2 and FIG. 3, the material cutting mechanism 5 includes the edge guide 51 and a knife 52. The edge guide 51 is located rearward of the curl-removing mechanism 4 and abuts the edges of the two materials Fi and Fo on the inner wheel side and the outer wheel side. Thus, the two materials Fi and Fo before being sewn can be positioned. The knife 52 is a known mechanism which is configured to be capable of cutting a specific range from the edges of the two materials Fi and Fo by reciprocally moving a blade on the tip and is located rearward of the edge guide 51. The knife 52 cuts the two materials Fi and Fo at a specific distance away from the edge guide 51 backward, that is, in the feed direction M.

The edge guide 51 and the knife 52 automatically perform the processes of positioning the edges of the two materials Fi and Fo after the curls C are straightened and thereafter cutting the specific range from the edges. Therefore, the processes on the edges of the two materials Fi and Fo are performed with high accuracy and uniformity. Accordingly, sewn products with high quality can be efficiently produced.

The edge guide 51 of this embodiment is movable in the left and right direction from the upper material sandwiching part 411. The edge guide 51 is fixed to the upper material sandwiching part 411 by a screw 511, as shown in the figure, and can be moved in the left and right direction by loosening the screw 511. Thus, a relative position between the edge guide 51 and the knife 52 is adjustable so as to allow the specific distance to be changed. The width of the two materials Fi and Fo on the inner wheel side and the outer wheel side to be cut by the knife 52 can be optionally set by adjusting the relative position between the edge guide 51 and the knife 52. Therefore, the two materials Fi and Fo cut to a constant width can be sewn, thereby allowing desired sewn products to be stably and efficiently produced. However, there is no limitation to this, and the edge guide 51 can be fixed.

The embodiment of the present invention has been described as above, but the present invention is not limited to the aforementioned embodiment, and various modifications can be made without departing from the gist of the present invention.

For example, the material sandwiching unit 41 of the embodiment belongs to the curl-removing mechanism 4 but can be configured to have only the function of simply sandwiching the two materials Fi and Fo without having the function of removing the curls.

The configuration and action of the aforementioned embodiment will be summarized below. The aforementioned embodiment is the sewing machine 1 including: the cylinder unit 3 configured to support the two materials Fi and Fo having annular edges by being inserted therethrough while they are stacked, with one being located on the inner wheel side and the other being located on the outer wheel side; the stitch plate 12 configured to support the material Fi on the inner wheel side supported by the cylinder unit 3 from below by abutting it; the material presser 13 configured to press the material Fo on the outer wheel side supported by the cylinder unit 3 above the stitch plate 12; and the material sandwiching unit 41 provided on the near side of the stitch plate 12 and the material presser 13 and configured to sandwich, from above and below, the two materials Fi and Fo stacked, with the material Fi on the inner wheel side being located on the lower side and the material Fo on the outer wheel side being located on the upper side.

According to this configuration, the cylinder unit 3 can be inserted through the two materials Fi and Fo having annular edges, so that the materials Fi and Fo can be sewn with their annular edges below the stitch plate 12. Therefore, the sight of the sewing operator is less likely to be blocked by the materials Fi and Fo. Further, there is no need to use one hand for ensuring the sight, and therefore both hands can be concentrated on the sewing operation. Further, the two materials Fi and Fo sandwiched by the material sandwiching unit 41 can be fed between the stitch plate 12 and the material presser 13. Therefore, stable sewing is possible.

Further, the configuration can be such that the material sandwiching unit 41 includes the curl-removing mechanism 4 configured to straighten the curls C occurring on the edges of the two materials Fi and Fo, the material sandwiching unit 41 serving as the curl-removing mechanism 4 has the inclined parts 4111 and 4121 having edges of shapes extending backward from the farther side of the edges of the materials Fi and Fo toward the edge side at the position where the edges of the two materials Fi and Fo pass therethrough, and the inclined parts 4111 and 4121 have the edge parts 4112 and 4122 having a smaller thickness on the near side than on the back side.

According to this configuration, the material sandwiching unit 41 has the inclined parts 4111 and 4121 as the curl-removing mechanism 4, and the inclined parts 4111 and 4121 have the edge parts 4112 and 4122, so that it is easy to position the material sandwiching unit 41 along the portions of the curls C occurring on the edges of the two materials Fi and Fo. Therefore, the curls C can be straightened up. Accordingly, the sewing is not interfered by the curls C, and the sewing operation can be efficiently performed.

Further, the edge guide 51 located rearward of the curl-removing mechanism 4 and configured to abut the edges of the two materials Fi and Fo, and the knife 52 located rearward of the edge guide 51 and configured to cut the two materials Fi and Fo at a specific distance from the edge guide 51 can be further provided.

According to this configuration, the edge guide 51 and the knife 52 automatically perform the processes of positioning the edges of the two materials Fi and Fo after the curls C are straightened and thereafter cutting them. Therefore, the processes on the edges of the two materials Fi and Fo are performed with high accuracy and uniformity. Thus, sewn products with high quality can be efficiently produced.

Further, a relative position between the edge guide 51 and the knife 52 is adjustable so as to allow the specific distance to be changed.

According to this configuration, the length of the two materials Fi and Fo to be cut by the knife 52 can be optionally set by adjusting the relative position between the edge guide 51 and the knife 52. Therefore, desired sewn products can be efficiently produced.

As described above, according to the aforementioned embodiment, the sight of the sewing operator is less likely to be blocked by the materials, and both hands can be concentrated on the sewing operation. Further, stable sewing is made possible by the material sandwiching unit 41. Therefore, particularly when sewing the two materials Fi and Fo having annular edges, operation efficiency is good.

The sewing machine of this embodiment is as described above, but the present invention is not limited to the aforementioned embodiment, and the design can be appropriately modified within the scope intended by the present invention. The operational advantages of the present invention are also not limited to the foregoing embodiments. The embodiments disclosed herein should be construed in all respects as illustrative but not limiting. The scope of the present invention is not indicated by the foregoing description but by the scope of the claims. Further, the scope of the present invention is intended to include all the modifications equivalent in the sense and the scope to the scope of the claims.

What is claimed is:

1. A sewing machine comprising:

a cylinder unit configured to support two materials having annular edges by being inserted therethrough, with one of the two materials being located on an inner side and the other one of the two materials being located on an outer side;

a stitch plate configured to support said one of the two materials on the inner side supported by the cylinder unit by abutting said one of the two materials on the inner side from below;

a material presser configured to press the other one of the two materials on the outer side supported by the cylinder unit above the stitch plate; and a material sandwiching unit provided on the near side of the stitch plate and the material presser and configured to sandwich, from above and below, the two materials stacked, with the one of the two materials on the inner side being located on the lower side and the remaining one of the two materials on the outer side being located on the upper side.

2. The sewing machine according to claim 1, wherein the material sandwiching unit comprises a curl-removing mechanism configured to straighten curls occurring on the edges of the two materials, the material sandwiching unit comprises, as the curl-removing mechanism, inclined parts having edges of shapes extending backward from the farther side of the edges of the two materials toward the edge side at the position where the edges of the two materials pass therethrough, and the inclined parts have edge parts having a smaller thickness on the near side than on the back side.

3. The sewing machine according to claim 2, further comprising:

an edge guide located rearward of the curl-removing mechanism and configured to abut the edges of the two materials; and a knife located rearward of the edge guide and configured to cut the two materials at a specific distance from the edge guide.

4. The sewing machine according to claim 3, wherein a relative position between the edge guide and the knife is adjustable so as to allow the specific distance to be changed.

* * * * *